US007559488B2

(12) United States Patent
Smout et al.

(10) Patent No.: US 7,559,488 B2
(45) Date of Patent: Jul. 14, 2009

(54) INJECTION NOZZLE

(75) Inventors: Christopher D Smout, Plymouth (GB); Louise A Connelly, Rainham (GB)

(73) Assignee: Delphi Technologies, Inc., Troy, MI (US)

( * ) Notice: Subject to any disclaimer, the term of this patent is extended or adjusted under 35 U.S.C. 154(b) by 358 days.

(21) Appl. No.: 11/202,799

(22) Filed: Aug. 12, 2005

(65) Prior Publication Data

US 2006/0032948 A1 Feb. 16, 2006

(30) Foreign Application Priority Data

Aug. 13, 2004 (EP) ..... 04254884

(51) Int. Cl.
*F02M 47/02* (2006.01)
*B05B 1/08* (2006.01)
*B05B 1/30* (2006.01)

(52) U.S. Cl. ..... 239/88; 239/89; 239/102.2; 239/584; 239/585.5

(58) Field of Classification Search ..... 239/102.2, 239/533.3, 533.6, 533.12, 584, 443, 444, 239/556, 558, 89, 585.5, 88
See application file for complete search history.

(56) References Cited

U.S. PATENT DOCUMENTS 6,378,503 B1 * 4/2002 Lambert ..... 123/468
6,557,776 B2 * 5/2003 Carroll et al. ..... 239/5
6,585,171 B1 * 7/2003 Boecking ..... 239/102.1
6,637,675 B2 * 10/2003 Carroll et al. ..... 239/533.4
6,769,635 B2 * 8/2004 Stewart et al. ..... 239/558
7,117,842 B2 * 10/2006 Boehland et al. ..... 123/299

FOREIGN PATENT DOCUMENTS

DE 10155227 5/2003
EP 1059437 12/2000

* cited by examiner

*Primary Examiner*—Davis Hwu
(74) *Attorney, Agent, or Firm*—David P. Wood

(57) ABSTRACT

An injection nozzle for an internal combustion engine includes a nozzle body having a first nozzle outlet, a second nozzle outlet and a delivery chamber for fuel, an outer valve needle engageable with an outer valve seating to control fuel injection through the first nozzle outlet and an inner valve needle engageable with an inner valve seating to control fuel injection through the second nozzle outlet. The outer valve needle is provided with an axial bore within which the inner valve needle is slidable. The injection nozzle further includes a sleeve member coupled to the inner valve needle and a ring member coupled to the outer valve needle, wherein the ring member is brought into engagement with the sleeve member when the outer valve needle is moved axially through a distance that is greater than a predetermined distance 'L' so as to cause axial movement of the inner valve needle.

12 Claims, 5 Drawing Sheets

INJECTION NOZZLE

The present invention relates to an injection nozzle for use in a fuel injection system for an internal combustion engine. More particularly, although not exclusively, the present invention relates to an injection nozzle for use in a compression ignition internal combustion engine in which first and second valve needles are operable to control the injection of fuel into a combustion space through a plurality of nozzle outlets.

Due to increasingly stringent environmental regulations, a great deal of pressure is levied upon automotive manufacturers to reduce the level of vehicle exhaust emissions, for example, hydrocarbons, nitrogen oxides (NOx) and carbon monoxide. As is well known, an effective method of reducing exhaust emissions is to supply fuel to the combustion space at high injection pressures (around 2000 bar for example) and to adopt nozzle outlets of a small diameter in order to optimise the atomisation of fuel and so improve efficiency and reduce the levels of hydrocarbons in the exhaust gases. Although the above approach is effective at improving fuel efficiency and reducing harmful engine exhaust emissions, an associated drawback is that reducing nozzle outlet diameter conflicts against the requirement for high fuel injection flow rates at high engine loads and so can compromise vehicle performance.

So-called "variable orifice nozzles" (VON-nozzles) enable variation in the number of orifices (therefore the total orifice area) used to inject fuel into the combustion space at different engine loads. Typically, such an injection nozzle has at least two sets of nozzle outlets with first and second valve needles being operable to control whether fuel injection occurs through only one of the sets of outlets or through both sets simultaneously. In a known injection nozzle of this type, as described in the Applicant's co-pending European patent application no. EP04250928, the fuel flow to a first (upper) set of nozzle outlets is controlled by an outer valve needle and the fuel flow to a second (lower) set of nozzle outlets is controlled by an inner valve needle. The inner valve needle is lifted by the outer valve needle only after the flow of fuel through the first set of nozzle outlets has reached a sufficient rate. An injection nozzle of this type enables selection of a small total nozzle outlet area in order to optimise engine emissions at relatively low engine loads. On the other hand, a large total nozzle outlet area may be selected so as to increase the total fuel flow at relatively high engine loads.

Although beneficial in many ways, such nozzles do have associated problems. For instance, in order to predetermine the distance through which the outer valve needle may lift before engaging and lifting the inner valve needle, it is necessary to manufacture a valve needle of complex form. This increased complexity carries with it an increased manufacturing cost which is undesirable in an industry subject to an unrelenting downward pressure on production costs. Furthermore, it has been an aim of prior nozzle designs to maintain high flow efficiency through the nozzle. However, due to the high injection pressures utilised by modem injection nozzles, high lateral loads tend to disrupt the positioning of the inner needle.

It is with a view to addressing the above problems that the present invention provides an improved variable orifice injection nozzle for use in an internal combustion engine, the injection nozzle including a nozzle body having a first nozzle outlet, a second nozzle outlet and a delivery chamber for fuel. An outer valve needle is engageable with an outer valve seating to control fuel injection through the first nozzle outlet and an inner valve needle is engageable with an inner valve seating to control fuel injection through the second nozzle outlet, wherein the outer valve needle is provided with an axial bore within which the inner valve needle is slidable. The injection nozzle further includes a sleeve member coupled to the inner valve needle and a ring member coupled to the outer valve needle, wherein the ring member is brought into engagement with the sleeve member when the outer valve needle is moved axially through a distance that is greater than a predetermined distance 'L' so as to cause axial movement of the inner valve needle.

Preferably, the sleeve member is coupled to the inner valve member through frictional engagement therewith. It is also preferable for the ring member to be coupled to the outer valve needle through frictional engagement therewith.

It is one benefit of the present invention that the predetermined distance 'L' can be established in a simple manner during manufacture and prior to insertion of the inner and outer valve needles into the nozzle body. Production techniques are thereby simplified and costs reduced as a result. Furthermore, utilising two components—the sleeve member and the ring member—enables the shape of the inner valve needle to be less complex since the predetermined distance 'L' is established by the separation of the ring member relative to the sleeve member. Further cost reductions are realised as a result of the simplified form of the needle, which, thus, may be manufactured more conveniently.

The ring member and the sleeve member may have respective first and second end faces, the first end face of the ring member being opposed to and spaced apart from the second end face of the sleeve member, wherein the maximum distance of separation of the first end face of the ring member and the second end face of the sleeve member is equal to the predetermined distance 'L'.

Preferably, the sleeve member and the ring member are substantially tubular.

Preferably, the second end face of the ring member abuts a shoulder provided by the inner valve needle. The shoulder may, therefore, provide a means by which to urge the ring member into the bore of the outer valve needle during an assembly operation.

Furthermore, the ring member serves to bias the inner valve needle into engagement with the inner valve seating.

A feature of the present invention is that in addition to a main flow path for fuel from the delivery chamber, past the outer valve seating and through the first nozzle outlet, preferably, a supplementary flow path for pressurised fuel is defined, in part, by a region of the axial bore. The supplementary flow path may be further defined by at least one radial passage defined in the outer valve needle, the radial passage being in fluid communication with the axial bore and the delivery chamber.

By way of example, the invention will now be described with reference to the accompanying drawings, in which.

Figure 1:
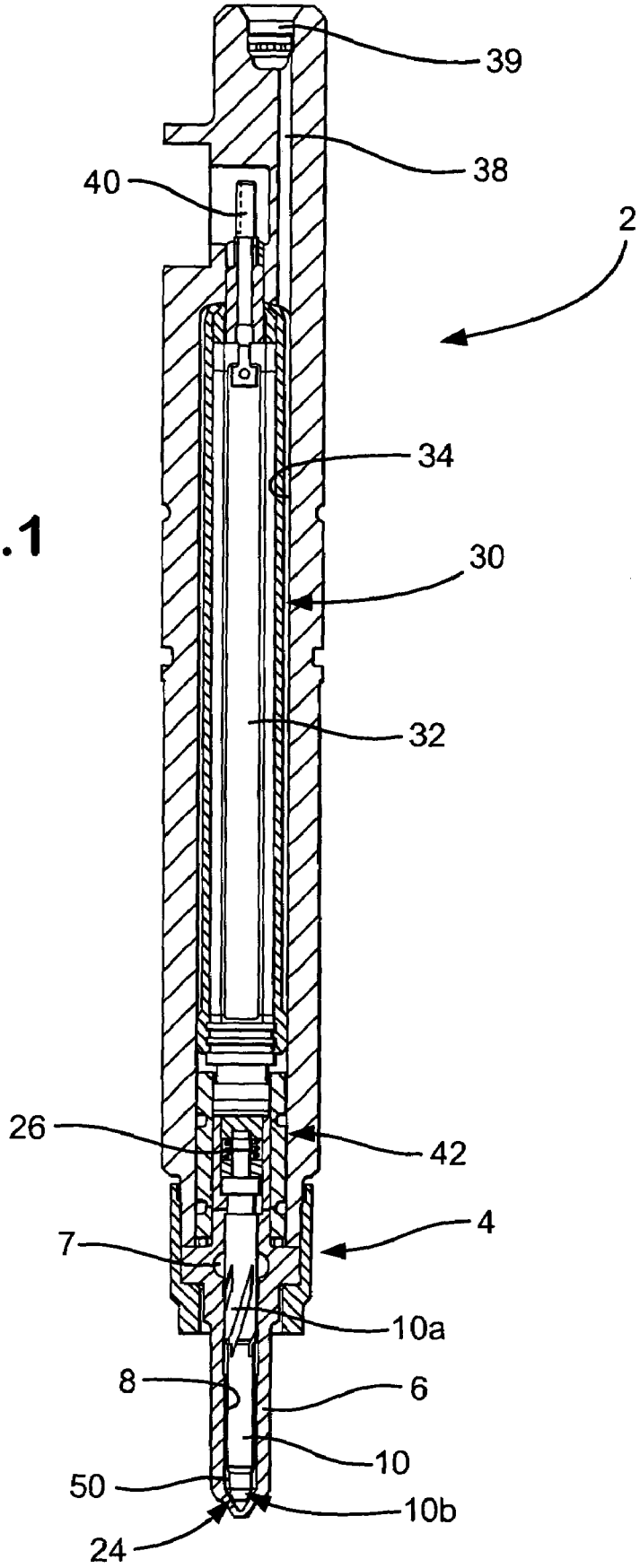
FIG. 1 is a part-sectional view of a fuel injector incorporating an injection nozzle in accordance with the present invention.

In the following description, the terms "upper" and "lower" are used having regard to the orientation of the injection nozzle as shown in the drawings. Likewise, the terms "upstream" and "downstream" are used with respect to the direction of fuel flow through the nozzle from a fuel inlet line to fuel outlets.

FIG. 1 shows a piezoelectric fuel injector, referred to generally as 2, within which the injection nozzle of the present invention may be incorporated. The injection nozzle, referred to generally as 4, is of the variable orifice nozzle type which includes a nozzle body 6 being provided with a blind axial bore 8 within which an outer valve needle 10 is slidably received for controlling injection through respective first and second sets of nozzle outlets (not shown in FIG. 1) provided in a nozzle body 6.

Fuel is supplied to the injector 2 via an inlet 39 from, for example, a common rail or other appropriate source of pressurised fuel, which is also arranged to supply fuel to one or more other injectors. Pressurised fuel is, therefore, communicated from the inlet 39, through an inlet passage 38 and an accumulator volume 34, to an annular chamber 7 defined within the bore 8 between the nozzle body 6 and an upper end region 10*a* of the outer valve needle 10. The upper end region 10*a* has a diameter substantially equal to that of the nozzle body bore 8 such that co-operation between these parts serves to guide movement of the outer valve needle 10 as it reciprocates within the bore 8, in use. Spiral flutes machined into the upper end region 10*a* provide a flow path for fuel to be communicated from the annular chamber 7, through the bore 8 and into a first delivery chamber 50. The delivery chamber 50 is defined between the outer surface of the outer valve needle 10 and the nozzle body bore 8 in a region upstream of the outlets.

The outer valve needle 10 is biased towards an outer valve seating 24 by means of a first closing spring 26 and is operable to move away from the outer valve seating 24, against the force provided by the biasing spring 26, by means of a piezoelectric actuator 30. The piezoelectric actuator 30 comprises a stack 32 of piezoelectric elements, arranged within the accumulator volume 34, and an electrical connector 40 to enable a voltage to be applied across the stack 32. In use, the accumulator volume 34 is filled with high pressure fuel so as to apply a hydrostatic loading to the stack 32. The piezoelectric actuator 30 is coupled to the outer valve needle 10 by way of a hydraulic amplifier arrangement 42 and so movement of the outer valve needle 10 is controlled by varying the voltage applied to the stack 32 in order to cause the stack 32 to extend and contract.

Figure 2:
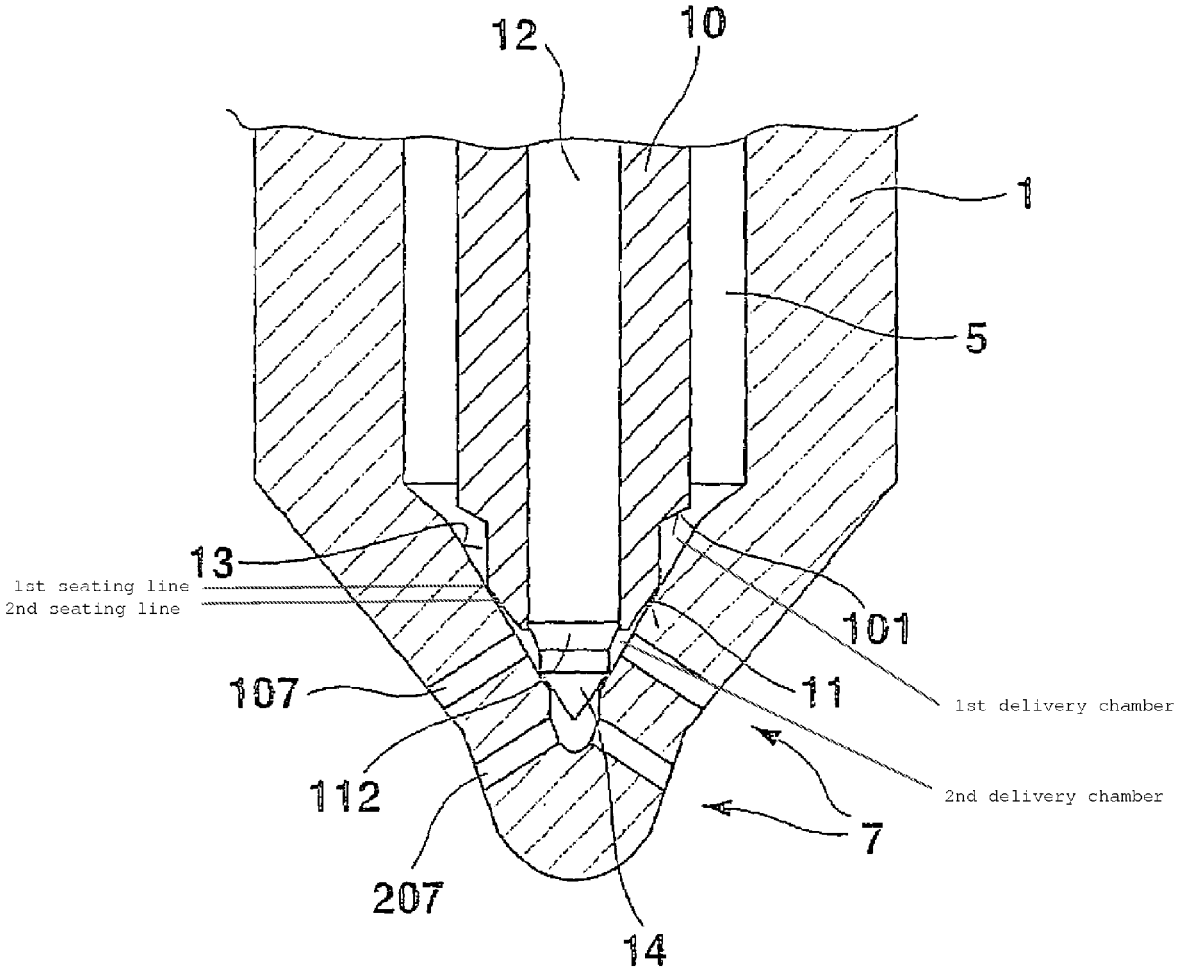
FIG. 2 is an enlarged part-sectional view of the injection nozzle in FIG. 1 when in a non-injecting position.

Referring to FIG. 2, toward its blind end, the bore 8 defines a seating surface 22 of conical form, terminating in a sac volume 20. The seating surface 22 defines the outer valve seating 24 with which a lower end region 10*b* of the outer valve needle 10 is engageable to control fuel injection through a first set of outlets 12. The injection nozzle 4 also includes an inner valve needle 14 slidably mounted within an axial bore 16 provided in the lower region 10*b* of the outer valve needle 10 and engageable with an inner valve seating 25 defined by the seating surface 22. Movement of the inner valve needle 14 towards and away from the inner valve seating 25 controls fuel injection through a second set of outlets 18. The inner valve needle 14 is not actuated directly but is caused to move through cooperating with the outer valve needle 10 once this has moved beyond a predetermined amount, as described below.

The inlet ends of the first set of outlets 12 extend radially away from the seating surface 22 and the inlet ends of the second set of outlets 18 are in communication with, and extend radially away from, the sac volume 20. In FIG. 2, the first and second sets of outlets 12, 18 are shown as having two or more outlets in each set, each set being disposed at a different axial position within the nozzle body 6. Equally, however, each set of outlets 12, 18 may include a single outlet. Therefore, for the purposes of this specification, any reference to 'outlet' shall be considered as applying to one or more outlets.

The blind end of the axial bore 16 provided in the outer valve needle 10 defines a chamber 62 which serves to accommodate the upper end of the inner valve needle 14. The chamber 62 is in communication with the nozzle body bore 8 via radial passages 53, in the form of cross drillings provided in the outer valve needle 10, which provide a venting function for the chamber 62. In addition, pressurised fuel within the chamber 62 acts on the inner valve needle 14 to provide a force to bias the inner valve needle 14 against its valve seating 25.

The lower end region 10*b* of the outer valve needle 10 is provided with further radial passages 52 in the form of cross drillings, wherein one end of each passage 52 communicates with the delivery chamber 50 and the other end communicates with the axial bore 16. The radial passages 52 define, in part, a supplementary flow path for fuel between the first (upper) delivery chamber 50 and a second (lower) delivery chamber 56 located axially below the first outlets 12. Therefore, when the outer valve needle 10 lifts away from the outer valve seating 24, fuel is able to flow from the second delivery chamber 56 into the first outlets 12 and, when the inner valve needle 14 lifts away from the inner valve seating 25, fuel is able to flow from the second delivery chamber 56 into the second outlets 18.

Figure 3:
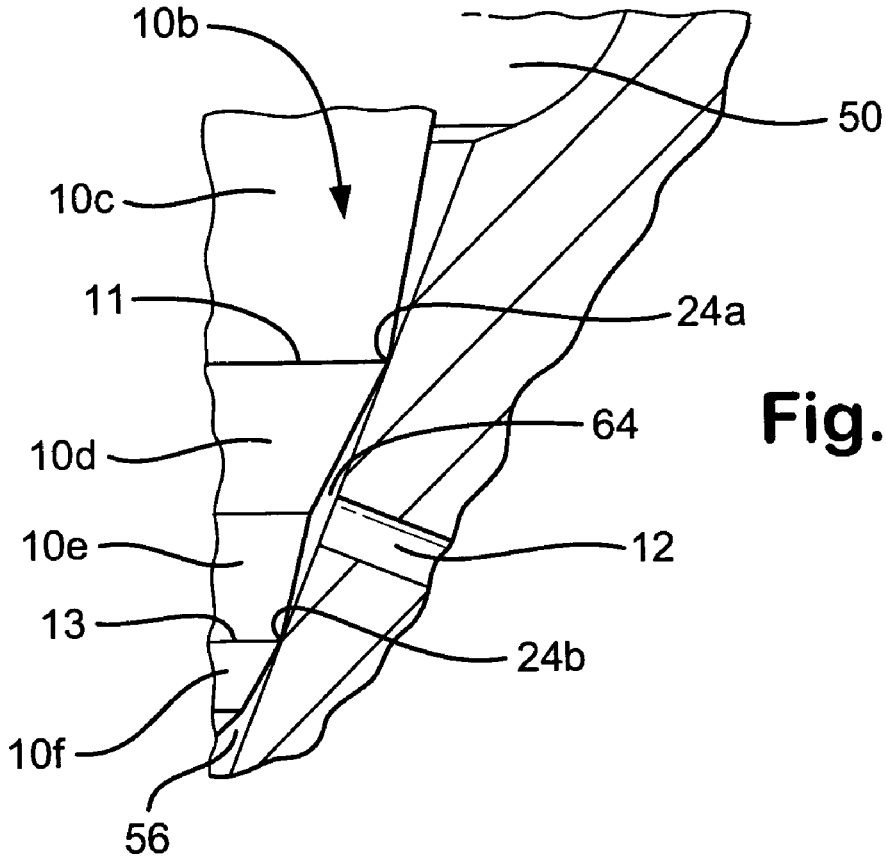
FIG. 3 is an enlarged part-sectional view of a part of the injection nozzle in FIG. 2.

FIG. 3 (scale exaggerated for clarity) shows that the seating region 10*b* of the outer valve needle 10 is shaped to define a first (upper) seating line 11 upstream of the first outlets 12 and a second (lower) seating line 13 downstream of the first outlets 12, when the needle 10 is seated. The outer valve needle 10 is provided with a grooved or recessed region which defines, at respective upper and lower edges thereof, the upper and lower seating lines 11, 13.

More specifically, FIG. 3 shows the lower end region 10*b* of the outer valve needle 10 comprises four distinct regions: an upper region 10*c*, an upper seat region 10*d*, a lower seat region 10*e* and an end region 10*f*. The regions 10*c* to 10*f* are not identified in FIG. 1 or 2 for the sake of clarity.

The upper seat region 10*d* and the lower seat region 10*e* together form the recessed region or groove of the outer valve needle 10 and define, together with the adjacent region of the seating surface 22, an annular volume or chamber 64 for fuel at the inlet end of each of the first outlets 12. The upper edge of the upper seat region 10*d* defines the first seating line 11 and the lower edge of the lower seat region 10*e* defines the lower seating line 13. The upper and lower seating lines 11, 13 engage the outer valve seating 24 at respective first and second seats 24*a*, 24*b*.

Referring once again to FIG. 2, the inner valve needle 14 is shaped to include three regions: an upper stem region 14*a*, a lower region 14*c*, and a step region 14*b* which is intermediate, and so separates, the stem region 14*a* and the lower region 14*c*. The step region 14*b* is of cylindrical form having a diameter which is substantially the same as the bore 16 provided in the outer valve needle 10. As a result, the step region 14*b* serves to guide movement of the inner valve needle 14 as it is moved into and out of engagement with the inner valve seating 25 to control fuel injection through the second outlets 18.

Figure 4:
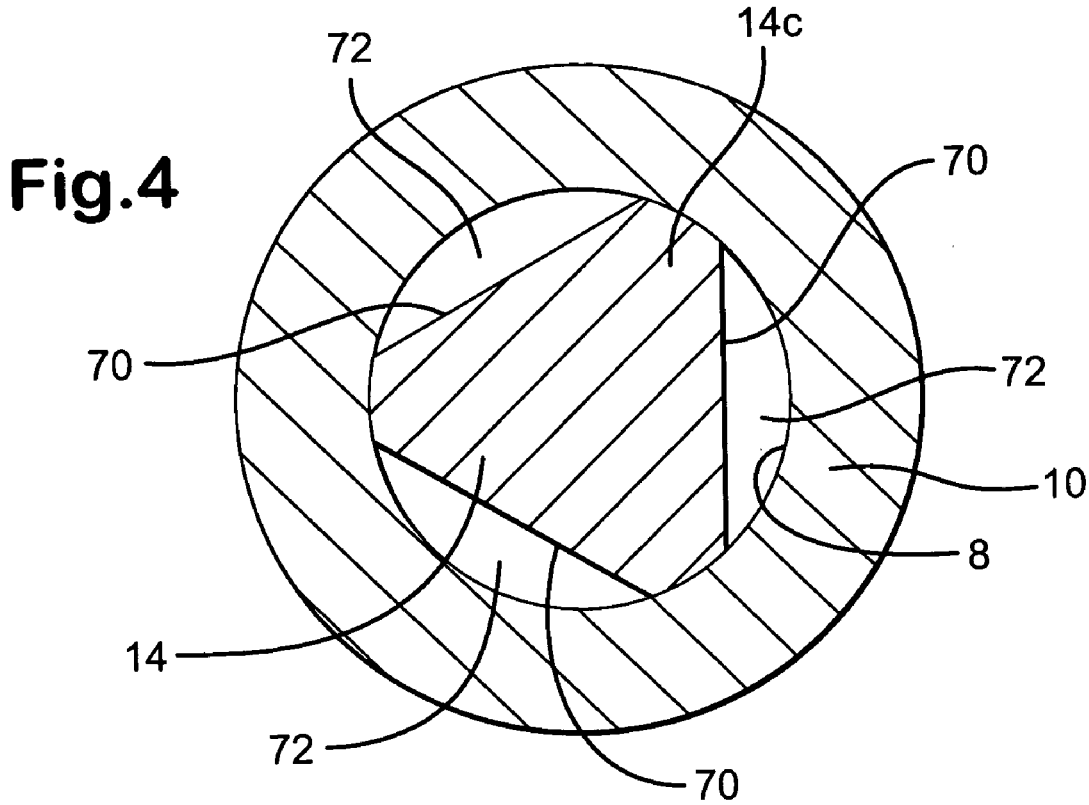
FIG. 4 is a sectional view of the injection nozzle taken along the line A-A in FIG. 2.

In order to provide additional guidance to the inner valve needle 14, the lower region 14*c* has a diameter substantially equal to that of the bore 16. As is shown in FIG. 4, the lower region 14*c* includes three flats 70, which, together with the bore 8, define three chambers 72 for fuel. The chambers 72 serve to limit restriction to fuel flow through the supplementary flow path to an acceptable level whilst the lower region 14*c* guides movement of the inner valve needle 14. Lateral movement of the lower region 14*c* due to the high pressure fuel flowing through the supplementary flow path, in use, is thus substantially eliminated. Although three flats are shown in FIG. 4, it will be appreciated that the lower region 14*c* may be machined with more flats, or alternatively, grooves or flutes, or still alternatively, a combination of flats, grooves and/or flutes. However, the aim is to achieve sufficient guidance of the lower region 14*c* whilst minimising the restriction to the flow of fuel through the supplementary flow path. The lower region 14*c* is of part spherical form and tapers or blends into a substantially conical seating region 14*d* that terminates at a cone tip. Since the inner valve needle lifts 14 away from its seating 25 by a relative small amount, the needle tip arrangement as described provides for an efficient flow path for fuel past the seating 25.

An annular member 80 in the form of a ring 80 is received within the bore 16 in the outer valve needle 10. The ring member 80 is a separate and distinct part and is coupled to the outer valve needle 10 through frictional contact between the outer surface of the ring member 80 and the surface of the bore 16 in the outer valve needle 10. That it to say, the ring member 80 is an interference fit with the bore 16.

The ring member 80 includes a first, upper end face 80*a* and a second, lower end face 80*b*, the lower end face 80*b* abutting a step or shoulder 15 defined by the step region 14*b* of the inner valve needle 14. The internal diameter of the ring member 80 is greater than the diameter of the stem region 14*a*, such that the stem region 14*a* passes through the ring member 80 and defines a clearance fit therewith. It will be appreciated that, in the position shown in FIG. 2, the inner valve needle 14 is held against its seating by the ring member 80 coupled to the outer valve needle 10.

The upper end face 80*a* of the ring member 80 opposes a first, lower end face 82*a* of a second annular member 82 in the form of a sleeve. The sleeve member 82 is a separate and distinct part from the inner valve needle 14 and has an external diameter that is less than that of the bore 16 and an internal diameter that is substantially equal to the diameter of the stem region 14*a*. Put another way, the sleeve member 82 is an interference fit with the stem region 14*a* and so is coupled to the stem region 14*a* through frictional contact.

As shown in FIG. 2, the lower end face 82*a* of the sleeve member 82 and the upper end face 80*a* of the ring member 80 are separated by a distance 'L' that is predetermined at manufacture. The distance 'L' determines by what amount it is necessary for the outer valve needle 10 to lift away from the outer valve seating 24 before engaging the inner valve needle 14 and conveying movement thereto. It should be appreciated that the lower end face 82*a* of the sleeve member 82 and the upper end face 80*a* of the ring member 80 are at maximum separation (i.e. predetermined distance 'L') when both the inner valve needle 14 and the outer valve needle 10 are seated.

Figure 5:
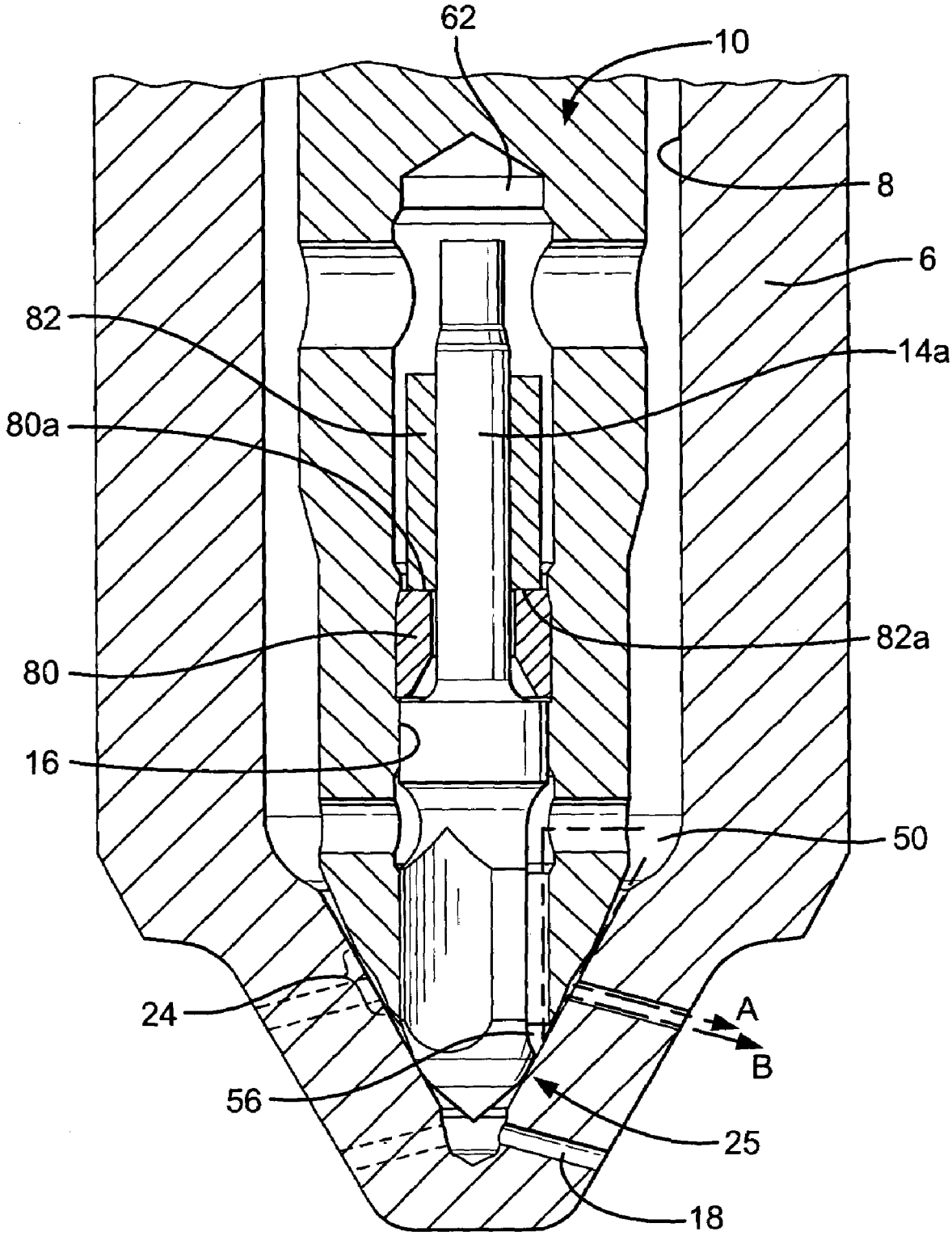
FIG. 5 is a sectional view of the injection nozzle in FIG. 2 when in a first injecting position.

Operation of the injector 2 will now be described. Fuel under high pressure is delivered from a high pressure fuel source (e.g. a common rail) to the nozzle bore 8 (and thus the upper and lower delivery chambers 50, 56) via the inlet 39, the inlet passage 38 and the stack volume 34. Initially, the piezoelectric actuator 30 is energised so that the stack 32 is in an extended state and, at this point, the outer valve needle 10 is held against its seating 24 due to the biasing force of the spring 26. The inner valve needle 14 is held against its seating due to the ring member 80 abutting the step region 14*b*. In this non-injecting state the actuator 30 is held at a relatively high energisation level. When the piezoelectric actuator 30 is de-energised to a first energisation level, the stack 32 is caused to contract, resulting in a lifting force being transmitted to the outer valve needle 10 by way of the hydraulic amplifier arrangement 42. The outer valve needle 10 is thus urged to move away from the outer valve seating 24, thereby disengaging the upper seating line 11 from the upper seat 24*a* and disengaging the lower seating line 13 from the lower seat 24*b*. This is the position shown in FIG. 5.

During this initial de-energisation of the actuator 30, the outer valve needle 10 is caused to move through a distance less than the distance 'L'. The ring member 80 is carried with the outer valve needle 10 during this initial movement because of the frictional engagement between the parts and so the upper end face 80*a* of the ring member 80 approaches, or moves towards, the opposing end face 82*a* of the sleeve member 82. At the same time, the lower end face 80*b* of the ring member 80 will disengage from the shoulder 15 of the step region 14*b*. Providing that the distance through which the outer valve needle 10 moves is less than the predetermined distance 'L', the upper end face 80*a* of the ring member 80 does not engage the lower end face 82*a* of the sleeve member 82. Therefore, the inner valve needle 14 remains seated against the inner valve seating 25, under the influence of pressurised fuel within the chamber 62 acting on the upper end of the inner valve needle 14.

When the outer valve needle 10 is moved through this initial amount, pressurised fuel is able to flow along a first flow path from the upper delivery chamber 50, past the upper seating line 11 into the annular volume 64 and through the first outlets 12 into the combustion chamber (not shown). Fuel will also be able to flow along the supplementary flow path from the delivery chamber 50, through the radial passages 52 and the axial bore 16 into the lower delivery chamber 56. Fuel in the lower delivery chamber 56 is then able to flow past the lower seating line 13 into the annular volume 64 and though the first outlets 12 into the combustion chamber. Therefore, when only the outer valve needle 10 lifts away from the outer valve seating 24, there are two flow paths for pressurised fuel to the first outlets: a first flow path (represented by arrow A) past the upper seat 24*a* directly from the upper delivery chamber 50 and a second flow path (represented by arrow B) past the lower valve seat 24*b*, indirectly from the upper delivery chamber 50 via the lower delivery chamber 56.

As long as the outer valve needle 10 moves away from the outer valve seating 24 by an amount less than the distance 'L', the inner valve needle 14 will remain seated against the inner valve seating 25 since the upper end face 80*a* of the ring member 80 is not caused to engage the lower end face 82*a* of the sleeve member. During this phase of injector operation, movement of outer valve needle 10 is therefore from decoupled from the inner valve needle 10. Whilst the inner valve needle 14 is seated against the inner valve seating 25, fuel is unable to flow from the lower delivery chamber 56 past the inner valve seating 25 to the second outlets 18. The above described condition represents fuel injection optimised for relatively low power applications since a relatively small volume of fuel is being injected through a first set of relatively small outlets 12 only.

If, at this point, it is necessary to terminate injection through the first outlets 12, the piezoelectric actuator 30 is re-energised to its initial energisation level causing the stack 32 to extend. As a result, the outer valve needle 10 is caused to re-engage with the outer valve seating 24, at both the first and second seats 24*a*, 24*b*, under the influence of the biasing force of the closure spring 26.

Figure 6:
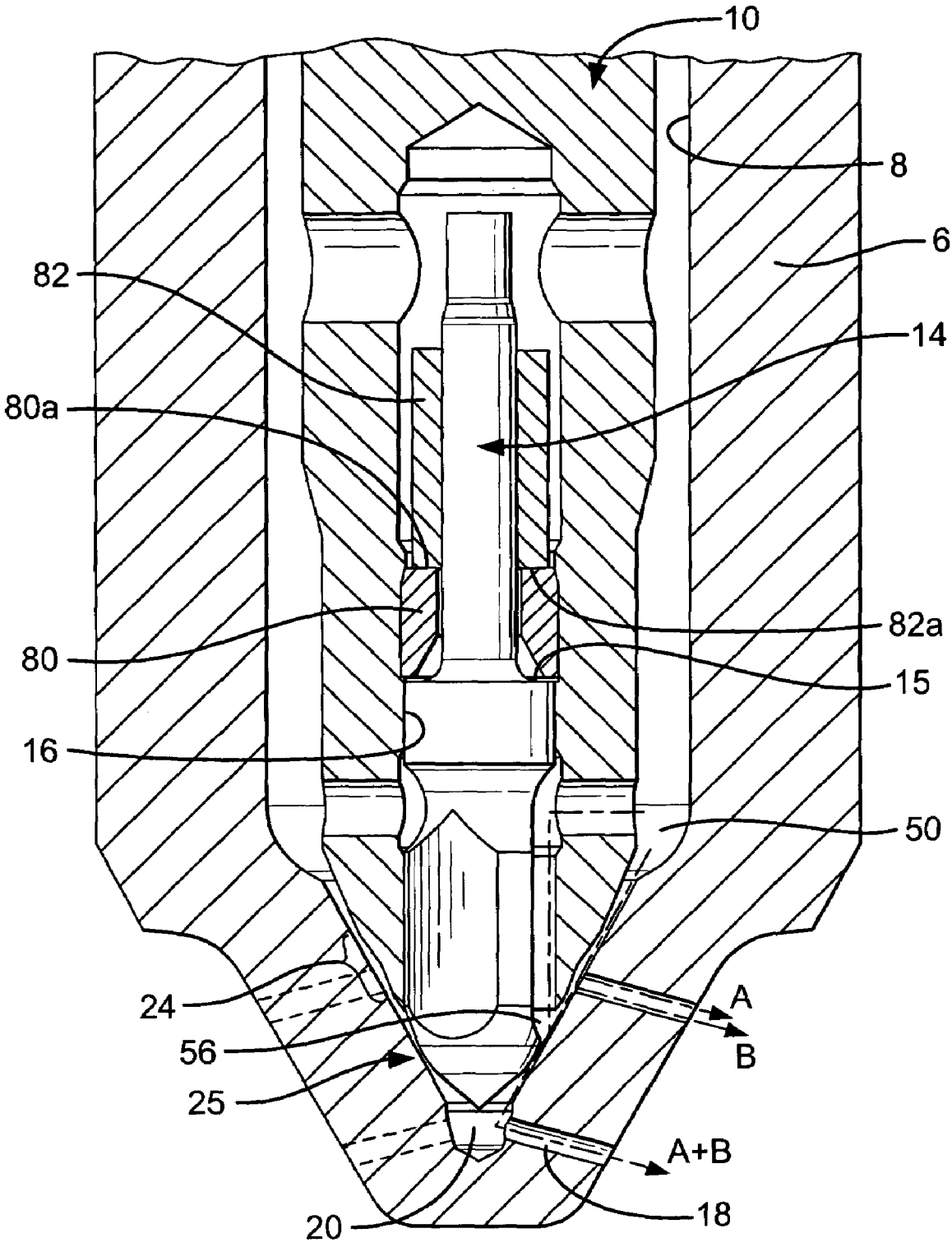
FIG. 6 is a sectional view of the injection nozzle in FIG. 2 when in a second injecting position.

FIG. 6 shows the injection nozzle during a subsequent, or alternative, stage of injector operation in which the piezoelectric actuator 30 may be de-energised further to a second energisation level causing the stack length to be reduced further. As a result, the outer valve needle 10 is urged away from the outer valve seating by a further amount, which is greater than the predetermined distance 'L'. In such circumstances, the upper end face 80*a* of the ring member 80 is caused to engage the lower end face 82*a* of the sleeve member 82, thereby causing the movement of the outer valve needle 10 to be conveyed or coupled to the inner valve needle 14 and causing the inner valve needle 14 to lift from its seating 25.

As the inner valve needle 14 lifts away from the inner valve seating 25, fuel within the lower delivery chamber 56 is able to flow through the second outlets 18 and into the combustion chamber, supplementing the fuel flowing past the outer valve seating 24 and through the first outlets 12. Initially, fuel will be drawn predominantly from the supplementary flow path B which is defined, in part, by the axial bore 16. However, as the inner valve needle 14 lifts away from the inner valve seating 25 by a greater distance, the second outlets 18 will also tend to draw fuel from flow path surrounding the outer valve needle 10 (flow path A), in addition to drawing fuel from supplementary flow path B.

A benefit of the invention is that robust guidance of the inner valve needle 14 is achieved. The step region 14*b* guides the intermediate region of the inner valve needle 14 since the diameter of the step region 14*b* is substantially the same as the bore 16. In addition and, perhaps, most importantly in practice, the lower region 14*c* guides the tip of the inner valve needle 14 to ensure that the concentricity of the valve tip is improved and a reliable seal is established with the inner valve seating 25.

Further, the presence of the chambers 72 established by the flats 70 machined on the surface of the lower region 14*c* ensures that the fuel flow through the supplementary flow path is not significantly restricted. Put another way, resistance to the flow of fuel is limited. In consequence, there is an increase in resilience of the inner valve needle 14 to the effects of the high lateral forces that result from fuel flow through the supplementary flow path. A more effective and reliable seal can therefore be established between the inner valve needle 14 and the inner valve seating 25.

A method by which the inner and outer valve needles 14, 10 may be assembled within the nozzle body 6 will now be described. Initially the ring member 80 is caused to receive the stem region 14*a* of the inner valve needle 14 so that the lower face 80*b* of the ring member 80 abuts the step region 14*b*. With the ring member 80 in position, the sleeve member 82 is then caused to receive the stem region 14*a* such that the ring member 80 is retained on the inner valve needle 14. In order to set the predetermined distance 'L', a spacer tool, such as a shim of thickness 'L' (not shown), is positioned against the upper end face 80*a* of the ring member 80, whereby the sleeve member 82 is pushed so as to engage the shim. When the shim is removed, the necessary separation of distance 'L' is established between the upper end face 80*a* of the ring member 80 and the lower end face 82*a* of the sleeve member 82.

Following assembly of the inner valve needle 14, the ring member 80, and the sleeve member 82, the combined inner valve needle 14 and ring/sleeve assembly 80, 82 is pushed into the bore 16 of the outer valve needle 10. The inner and outer valve needles 14, 10 together are then inserted into the nozzle body bore 8 such that the seating lines 11, 13 of the outer valve needle 10 engage with their respective seats 24*a*, 24*b* and the inner valve needle 14 engages the inner valve seating 25. Following assembly of the nozzle a bedding operation is performed in order to establish effective seals at the inner and outer seatings 24, 25. The seat bedding operation comprises applying a constant predetermined axial force to the outer valve needle 10, causing the upper and lower seating lines 11, 13 to "bed in" over the upper and lower seats 24*a*, 24*b* respectively. As an alternative to applying a predetermined constant axial force to the outer valve needle 10, the bedding in operation could also be dynamic.

It will be understood by those who practice the invention and those skilled in the art, that various modifications and improvements may be made to the invention without departing from the scope of the invention, as defined by the claims. Accordingly, reference should be made to the claims and other conceptual statements herein rather than foregoing the specific description in determining the scope of the invention.

For example, although the inner valve needle 14 is forced into engagement with its seating 25 by the ring member 80 abutting the shoulder of the step region 14*b*, it is possible that, in use, the lower end face 80*b* of the ring member 80 may wear such that a clearance is established between the lower end face 80*b* and the shoulder 15 when the inner and outer valve needles 14, 10 are seated. This may compromise the seal established by the inner valve needle 14. A resilient member such as a helical spring (not shown) may be arranged within the chamber 62 to provide a further biasing force to the inner valve needle 14. Such a spring may abut against the upper end face 82*b* of the sleeve member 82 such that the biasing force is transmitted to the inner valve needle 14 via the frictional coupling between these parts. Alternatively the spring may abut a separate abutting member.

Furthermore, although the ring member 80 and the sleeve member 82 are coupled to the outer valve needle 10 and inner valve needle 14, respectively, through frictional contact, it will be appreciated that coupling may be achieved through alternative means, for example by gluing or soldering. Further, the ring member 80 may be in the form of a "C shaped pin member having lateral resilience, by which means the ring member 80 maintains frictional contact with the bore 16.

It should be understood that although the injection nozzle 4 of the present invention has been described as suitable for use within an injector having a piezoelectric actuator, it is entirely possible that the injector may include an alternative form of actuator for moving the needles 10, 14. For example, instead of a piezoelectric actuator, the outer valve needle 10 may be moved by means of an electromagnetic actuator. Moreover, although the piezoelectric actuator 30 is described here as being coupled to the outer valve needle 10 via a hydraulic amplifier arrangement, as an alternative the actuator may be mechanically coupled to the outer valve needle 10.

The invention claimed is:

1. An injection nozzle for an internal combustion engine, the injection nozzle including:

a nozzle body having a first nozzle outlet, a second nozzle outlet and a first delivery chamber for fuel;

an outer valve needle engageable with an outer valve seating to control fuel injection through the first nozzle outlet;

an inner valve needle engageable with an inner valve seating to control fuel injection through the second nozzle outlet, wherein the outer valve needle is provided with an axial bore within which the inner valve needle is slidable;

the injection nozzle further including: a sleeve member coupled to the inner valve needle and a ring member coupled to the outer valve needle, wherein the ring member is brought into engagement with the sleeve member when the outer valve needle is moved axially through a distance that is greater than a predetermined distance so as to impart axial movement to the inner valve needle;

wherein the outer valve needle defines first and second seating lines for engagement with first and second seats, respectively, defined by the outer valve seating;

wherein cooperation between the first seating line and the first seat controls fuel flow between the first delivery chamber and the first nozzle outlet and cooperation between the second seating line and the second seat controls fuel flow between a second delivery chamber and the first nozzle outlet and wherein the first delivery chamber communicates with the second delivery chamber via a supplementary flow path defined, at least in part, by a region of the axial bore and at least one radial passage defined in the outer valve needle, the radial passage being in fluid communication with the axial bore and the first delivery chamber.

2. The injection nozzle as claimed in claim 1, wherein the ring member and the sleeve member have respective first and second end faces, the first end face of the ring member being opposed to and spaced apart from the second end face of the sleeve member by the predetermined distance when the outer valve needle and the inner valve needle are seated.

3. The injection nozzle as claimed in claim 2, wherein the second end face of the ring member abuts a shoulder provided by the inner valve needle.

4. The injection nozzle as claimed in claim 1, wherein the sleeve member is substantially tubular.

5. The injection nozzle as claimed in claim 1, wherein the ring member is substantially tubular.

6. The injection nozzle as claimed in claim 1, wherein the sleeve member is coupled to the inner valve needle through frictional engagement.

7. The injection nozzle as claimed in claim 1, wherein the ring member is coupled to the outer valve needle through frictional engagement.

8. An injector for use in an internal combustion engine, wherein the injector includes an injection nozzle as claimed in claim 1 and an actuator for controlling axial movement of the outer valve needle.

9. An injector as claimed in claim 8, wherein the actuator is a piezoelectric actuator.

10. An injection nozzle for an internal combustion engine, the injection nozzle including:

a nozzle body having a first nozzle outlet, a second nozzle outlet and a first delivery chamber for fuel;

an outer valve needle engageable with an outer valve seating to control fuel injection through the first nozzle outlet, the outer valve needle defining first and second seating lines for engagement with first and second seats, respectively, defined by the outer valve seating; an inner valve needle engageable with an inner valve seating to control fuel injection through the second nozzle outlet, wherein the outer valve needle is provided with an axial bore within which the inner valve needle is slidable;

the injection nozzle further including a sleeve member coupled to the inner valve needle and a ring member coupled to the outer valve needle, wherein the ring member and the sleeve member have respective first and second end faces, the first end face of the ring member being opposed to and spaced apart from the second end face of the sleeve member by a predetermined distance when the outer valve needle and the inner valve needle are seated, and wherein the ring member is brought into engagement with the sleeve member when the outer valve needle is moved axially through a distance that is greater than the predetermined distance so as to impart axial movement to the inner valve needle;

wherein cooperation between the first seating line and the first seat controls fuel flow between the first delivery chamber and the first nozzle outlet and cooperation between the second seating line and the second seat controls fuel flow between a second delivery chamber and the first nozzle outlet and wherein the first delivery chamber communicates with the second delivery chamber via a supplementary flow path defined, at least in part, by a region of the axial bore and at least one radial passage defined in the outer valve needle, the radial passage being in fluid communication with the axial bore and the first delivery chamber.

11. An injector for use in an internal combustion engine, wherein the injector includes an injection nozzle as claimed in claim 10 and an actuator for controlling axial movement of the outer valve needle.

12. An injector as claimed in claim 11, wherein the actuator is a piezoelectric actuator.

* * * * *